US005328065A

United States Patent [19]

Kolton et al.

[11] Patent Number: 5,328,065

[45] Date of Patent: Jul. 12, 1994

[54] GARMENT HANGER

[75] Inventors: Chester Kolton, Westfield; Stuart S. Spater, Livingston, both of N.J.

[73] Assignee: B&G Plastics, Inc., Newark, N.J.

[21] Appl. No.: 39,864

[22] Filed: Mar. 30, 1993

[51] Int. Cl.[5] ..... A47G 25/74; A47G 25/14

[52] U.S. Cl. ..... 223/85; 223/87; 223/DIG. 1

[58] Field of Search ..... 223/85, 87, DIG. 1, 223/DIG. 4, 81, 82; 206/289, 290; D6/315

[56] References Cited

U.S. PATENT DOCUMENTS

| | | | |
|---|---|---|---|
| D. 254,644 | 4/1980 | Abramowitz | 223/DIG. 1 |
| D. 259,164 | 5/1981 | Abramowitz | 223/DIG. 1 |
| 2,264,957 | 12/1941 | Shafarman | 223/DIG. 1 |
| 2,626,735 | 1/1953 | Gwinn et al. | 223/87 |
| 3,945,500 | 3/1976 | Mecksworth | 223/DIG. 1 |
| 4,765,467 | 8/1988 | Kolton et al. | 223/DIG. 1 |
| 5,110,019 | 5/1992 | Kolton et al. | 223/87 |
| 5,123,577 | 6/1992 | Kolton et al. | 223/85 |

FOREIGN PATENT DOCUMENTS

| | | | |
|---|---|---|---|
| 66776 | 5/1969 | German Democratic Rep. | 223/DIG. 1 |
| 310204 | 12/1955 | Switzerland | 223/DIG. 1 |

*Primary Examiner*—Clifford D. Crowder
*Assistant Examiner*—Bibhu Mohanty
*Attorney, Agent, or Firm*—Robin, Blecker, Daley & Driscoll

[57] ABSTRACT

A garment hanger is comprised of an upstanding integral plastic body having a hook portion and a main body portion depending from the hook portion, the main body portion defining first and second horizontally extending openings therethrough with a first upper continuous course of the main body portion upwardly bounding the first opening and a second lower continuous course of said main body portion lowerly bounding the second opening, the main body portion supporting first and second horizontally extending arms respectively lowerly bounding the first opening and upwardly bounding the second opening, the first and second arms having respective free ends in interfering disposition vertically of said hanger.

11 Claims, 4 Drawing Sheets

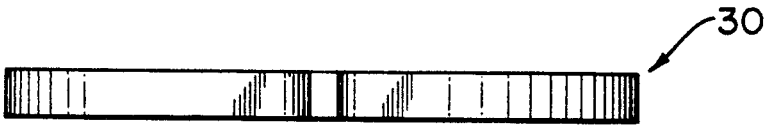
FIG. 4
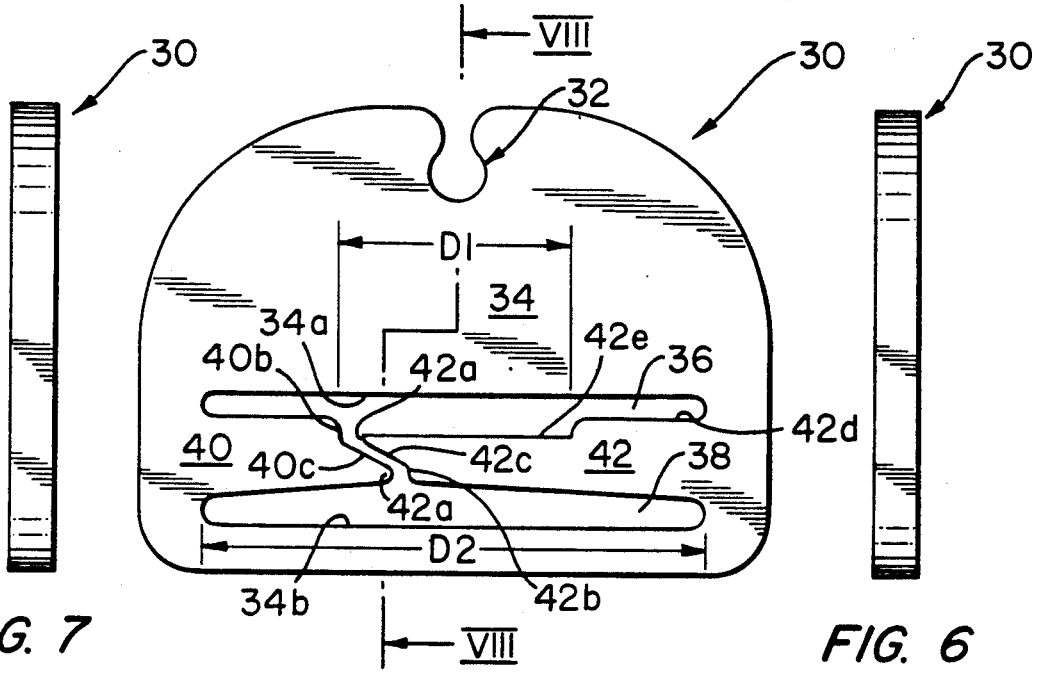
FIG. 7
FIG. 6
FIG. 3
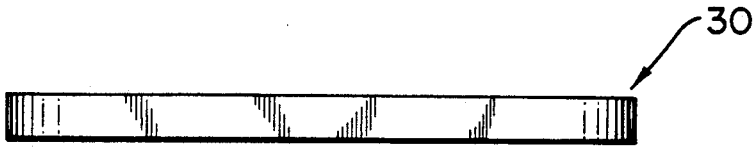
FIG. 5

GARMENT HANGER

FIELD OF THE INVENTION

This invention relates generally to hangers for garments and pertains more particularly to hangers for enhanced retention of garments, such as ties.

BACKGROUND OF THE INVENTION

Commercially-known tie hangers are evidenced by the showings of FIGS. 1 and 2. Referring to FIG. 1, hanger 10 comprises a plastic body having a hook portion 12*a* and a main body portion 12*b* integrally-formed with the hook portion and depending therefrom. Main body portion defines first and second slots 14 and 16, a central deflectable part 18 bounding slots 14 and 16, respectively below and above the same, and a lower deflectable part 20, downwardly bounding slot 16. Deflectable parts 18 and 20 have respective retention courses 18*a* and 20*a*, which serve to retain ties resident in slots 14 and 16, the slots being open at their leftward extents. In use of the FIG. 1 hanger, parts 18 and 20 are mutually deflected out of the plane of main body portion 12*b* and a fold of the tie is applied about part 18 with the parts then self-biasingly returning to the plane of main body portion 12*b* with the tie depending from the hanger.

Hanger 22 of FIG. 2 has hook portion 24 and main body portion 26 dependent therefrom. Here, main body portion 26 has a single deflectable part 28 with retention course 28*a*.

Applicants herein see a disadvantage common to both of the prior art hangers shown in FIGS. 1 and 2, namely, that the deflectable part or parts in each thereof are almost coextensive laterally with the main body portions thereof, giving rise to the need for assembly forces displacing the full extent of the deflectable part out of the plane of the main body portions.

Applicants note that there are known garment hanger arrangements in which the noted disadvantage of the embodiments of FIGS. 1 and 2 is seemingly overcome, i.e., wherein plural deflectable parts, each of less than half of the lateral extent of the main body portion, are disposed in centrally spaced manner along a central axis of the hanger. However, such arrangement is seen as disadvantageously permitting loss of hanging, i.e., wherein the garment escapes from hung relation by passing through the space between the mutually deflectable and spaced parts.

SUMMARY OF THE INVENTION

The present invention has as its primary object the provision of improved garment hangers.

A more particular object of the invention is the provision of improved tie hangers of the type having plural, deflectable parts adapted to support the hung garment, e.g., such as a tie.

A quite specific object of the subject invention is to provide a hanger for ties which is adapted for the hanging of ties in customary half-folded condition and also in a "quarter-folded" condition.

In attaining the foregoing and other objects, the invention provides a garment hanger comprised of an upstanding integral plastic body having a hook portion and a main body portion depending from the hook portion, the main body portion defining first and second horizontally extending openings therethrough with a first upper continuous course of the main body portion upwardly bounding the first opening and a second lower continuous course of said main body portion lowerly bounding the second opening, the main body portion supporting first and second horizontally extending arms respectively lowerly bounding the first opening and upwardly bounding the second opening, the first and second arms having respective free ends in interfering disposition vertically of said hanger. Based on such interfering disposition, the hanger of the invention affords enhanced retention of hung garments, particularly ties, since the hung garment does not have an escape passage through the interfering arms.

The foregoing and other objects and features of the invention will be further understood from a consideration of the following detailed description of preferred embodiments thereof and from the drawings, now described in summary manner.

DESCRIPTION OF THE DRAWINGS

FIG. 3 is a front elevation of a first embodiment of a hanger in accordance with the invention.

FIG. 4 is a top plan view of the FIG. 3 hanger.

FIG. 5 is a bottom plan view of the FIG. 3 hanger.

FIG. 6 is a right side elevation of the FIG. 3 hanger.

FIG. 7 is a left side elevation of the FIG. 3 hanger.

DETAILED DESCRIPTION OF PREFERRED EMBODIMENTS

Figure 1:
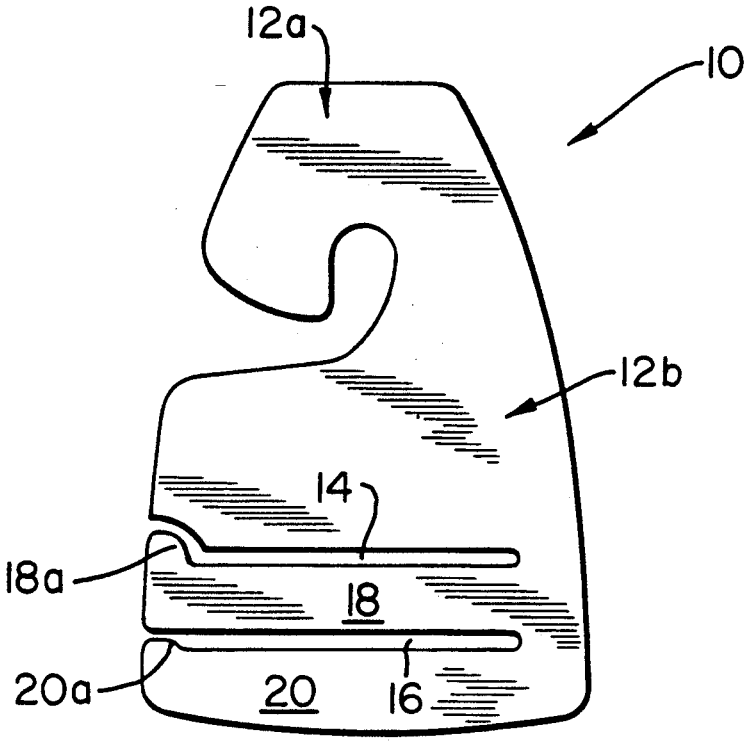
FIG. 1 (PRIOR ART)
FIGS. 1 and 2 are respective front elevations of prior art tie hangers.
Figure 2:
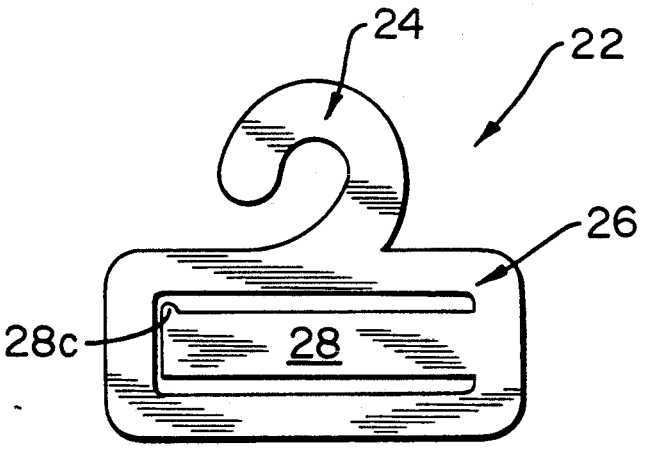
FIG. 2 (PRIOR ART)
Figure 8:
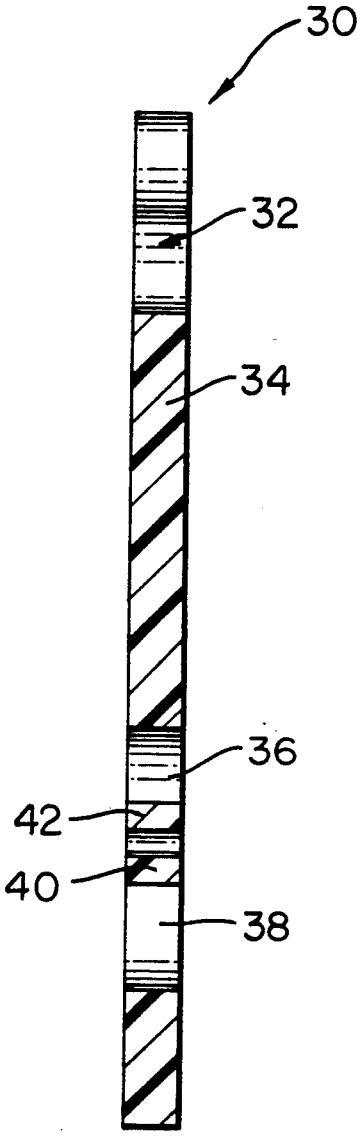
FIG. 8 is an enlarged sectional view of the FIG. 3 hanger as would be seen from plane VIII—VIII of FIG. 3.

Referring to FIGS. 3–8 hanger 30 is comprised of an upstanding integral plastic body having a hook portion 32 and a main body portion 34 depending from the hook portion. Main body portion 34 defines first and second horizontally extending openings 36 and 38 therethrough with a first upper continuous course 34*a* of the main body portion upwardly bounding first opening 36 and a second lower continuous course 34*b* of the main body portion lowerly bounding second opening 38.

Main body portion 34 supports first and second horizontally extending arms 40 and 42 respectively lowerly bounding first opening 36 and upwardly bounding second opening 38. The first and second arms have respective free ends 40*a* and 42*a*.

As is illustrated particularly in FIG. 3, free ends 40*a* and 40*b* are disposed in horizontally spaced relation to each other. First arm 40 defines an intermediate course 40*b* extending generally vertically downwardly of the hanger and a further course 40*c* extending to free end 40*a* of first arm 40. Second arm 42 defines an intermediate course 42*b* extending generally vertically downwardly of the hanger and a further course 42*c* extending to free end 42*a* of second arm 42. As is seen also in FIG. 3, courses 40*c* and 42*c* of first and second arms 40 and 42 are in interfering disposition vertically of the hanger and are respectively oppositely inclined vertically of the hanger.

Arm 42 has its upper surface 42*d* downwardly indented or recessed at 42*e*, and the measure D1 in FIG. 3, i.e., the horizontal extent of recess 42*e*, and the clearance beyond free end 42*a* to arm 40, is selected to correspond generally to the width of the fold of a tie folded in half. Accordingly, hanger 30 has facility for the hanging of one-half folded ties. Further, the measure D2 in FIG. 3, i.e., the horizontal extent of openings 36 and 38, is selected to correspond generally to the width of the fold of a tie which is again folded, so as to be quarter-folded. Accordingly, hanger 30 has further facility for the hanging of quarter folded ties.

Figure 9:
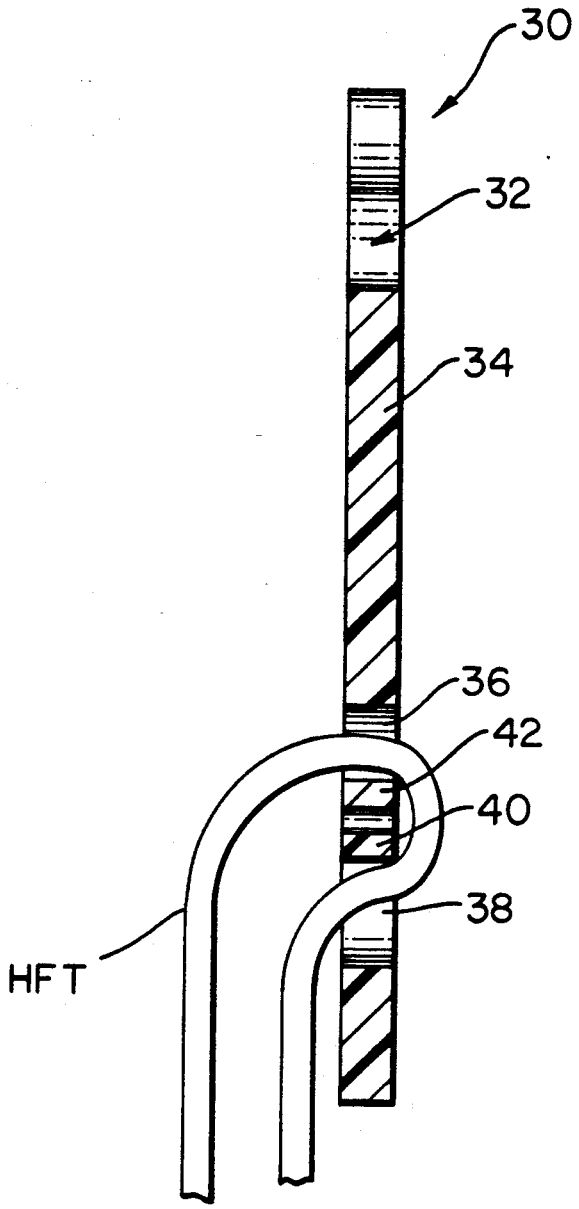
FIG. 9 is an enlarged side elevation of the FIG. 3 hanger assembled with a tie as would be seen from plane VIII—VIII of FIG. 3.

FIG. 9 illustrates, in side elevation, a half-folded tie HFT assembled with hanger 30. In reaching the assembly, arm 42 is deflected out of the plane of hanger 30 and the half-folded tie HFT is applied thereto. Arm 42, with the half-folded tie HFT on its recessed portion 42*e*, is now returned to the plane of hanger 30, completing the assembly. Based on such interfering disposition of arms 40 and 42, hanger 30 affords enhanced retention of hung garments, particularly ties, since the hung garment does not have an escape passage through the interfering arms.

Figure 10:
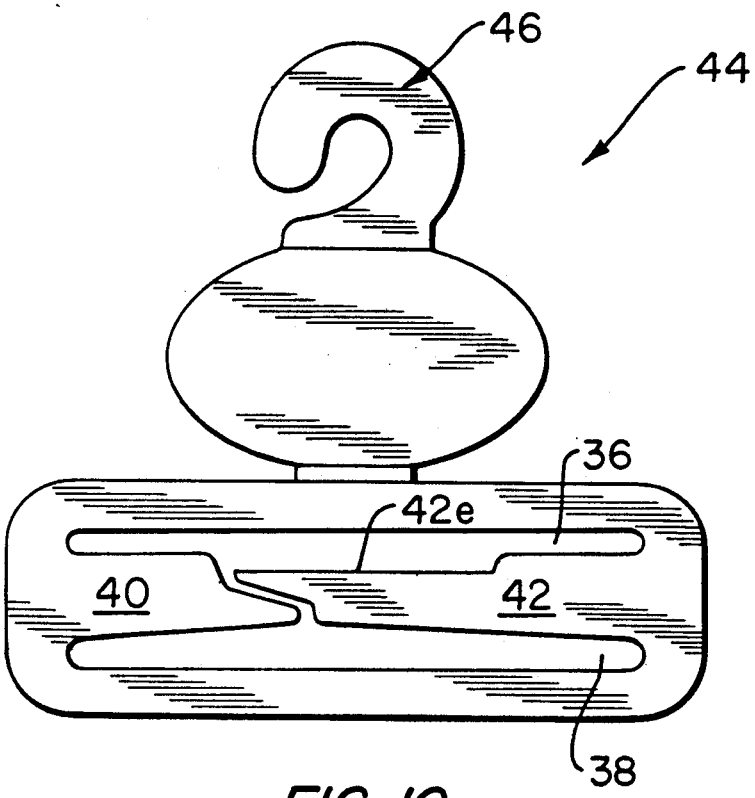
FIG. 10 is a front elevation of a second embodiment of a hanger in accordance with the invention.

Turning to FIG. 10, hanger 44 of the invention has its main body portion configured as in the case of the first embodiment above discussed. It differs, however, in its hook portion 46. Thus, while the first embodiment hook portion is recessed, hook portion 46 extends upwardly and outwardly of hanger 44. As will be appreciated, the first embodiment is useful in display where height limitations apply, since it can be realized with less vertical extent than in the case of the second embodiment. In each embodiment, space exists below the hook portion for display of logo or other marketing/size information.

Figure 11:
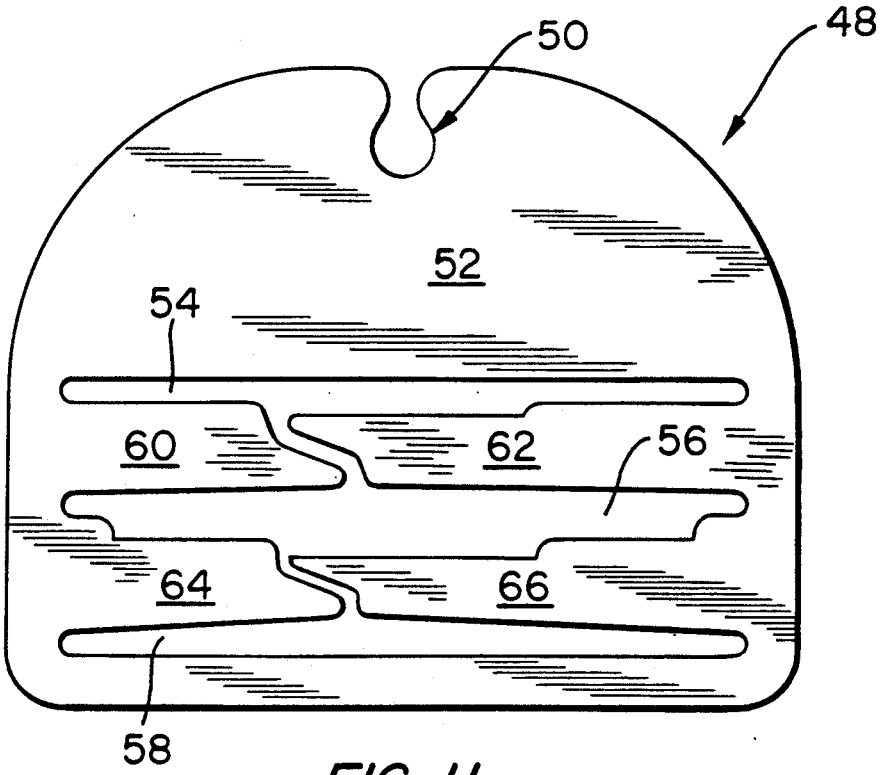
FIG. 11 is a front elevation of a third embodiment of a hanger in accordance with the invention.

Referring to FIG. 11, hanger 48, a third embodiment of the invention, is comprised of an upstanding integral plastic body having a hook portion 50 and a main body portion 52 depending from the hook portion, the main body portion defining first, second and third horizontally extending openings therethrough indicated at 54, 56 and 58. A first upper continuous course of the main body portion upwardly bounds first opening 54 and a second lower continuous course of the main body portion lowerly bounds third opening 58. The main body portion supports first and second horizontally extending arms 60 and 62, respectively lowerly bounding first opening 54 and upwardly bounding second opening 56 and third and fourth horizontally extending arms 64 an 66, respectively lowerly bounding third opening 58 and upwardly bounding second opening 56. The first and second arms have respective free ends in interfering disposition vertically of said hanger and the third and fourth arms have respective free ends in interfering disposition vertically of said hanger.

Various changes in structure to the described hangers and assemblies may evidently be introduced without departing from the invention. Accordingly, it is to be understood that the particularly disclosed and depicted embodiments are intended in an illustrative and not in a limiting sense. The true spirit and scope of the invention is set forth in the following claims.

What is claimed is:

1. A garment hanger comprised of an upstanding integral plastic body having a hook portion and a main body portion depending from said hook portion, said main body portion defining first and second horizontally extending openings therethrough with a first upper continuous course of said main body portion upwardly bounding said first opening and a second lower continuous course of said main body portion lowerly bounding said second opening, said main body portion supporting first and second horizontally extending arms respectively lowerly bounding said first opening and upwardly bounding said second opening, said first and second arms having respective free ends which overlap horizontally and are disposed at respective different location horizontally of said hanger so as to be in mutually interfering disposition vertically of said hanger.

2. The hanger claimed in claim 1, wherein said first arm defines an intermediate course extending generally vertically downwardly of said hanger and a further course extending to said free end of said first arm.

3. The hanger claimed in claim 2, wherein said second arm defines an intermediate course extending generally vertically upwardly of said hanger and a further course extending to said free end of said second arm.

4. The hanger claimed in claim 4, wherein said intermediate courses of said first and second arms are in interfering disposition vertically of said hanger.

5. The hanger claimed in claim 4, wherein said intermediate courses of said first and second arms are respectively oppositely inclined vertically of said hanger.

6. The hanger claimed in claim 1, wherein said first arm defines a vertically recessed course leading to said free end thereof.

7. The hanger claimed in claim 6, wherein said first arm defines an intermediate course extending generally vertically downwardly of said hanger and a further course extending to said free end of said first arm.

8. The hanger claimed in claim 7, wherein said second arm defines an intermediate course extending generally vertically upwardly of said hanger and a further course extending to said free end of said second arm.

9. The hanger claimed in claim 8, wherein said intermediate courses of said first and second arms are in interfering disposition vertically of said hanger.

10. The hanger claimed in claim 9, wherein said intermediate courses of said first and second arms are respectively oppositely inclined vertically of said hanger.

11. A garment hanger comprised of an upstanding integral plastic body having a hook portion and a main body portion depending from said hook portion, said main body portion defining first, second and third horizontally extending openings therethrough with a first upper continuous course of said main body portion upwardly bounding said first opening and a second lower continuous course of said main body portion lowerly bounding said third opening, said main body portion supporting first and second horizontally extending arms respectively lowerly bounding said first opening and upwardly bounding said second opening, said main body portion further supporting third and fourth horizontally extending arms respectively lowerly bounding said third opening and upwardly bounding said second opening, said first and second arms having respective free ends which overlap horizontally and are disposed at respective different locations horizontally of said hanger so as to be in mutually interfering disposition vertically of said hanger, said third and fourth arms having respective free ends which overlap horizontally and are disposed at respective different locations horizontally of said hanger so as to be in mutually interfering disposition vertically of said hanger.

* * * * *